United States Patent [19]

Itoh

[11] 4,420,680

[45] Dec. 13, 1983

[54] HEAT ROLLER TYPE FIXING MEANS

[75] Inventor: Takashi Itoh, Hachioji, Japan

[73] Assignee: Konishiroku Photo Industry Co., Ltd., Tokyo, Japan

[21] Appl. No.: 373,845

[22] Filed: May 3, 1982

[30] Foreign Application Priority Data

May 18, 1981 [JP] Japan ..... 56-73514

[51] Int. Cl.[3] ..... H05B 1/00

[52] U.S. Cl. ..... 219/469; 29/123; 100/93 RP; 156/555; 156/582; 219/216; 432/228

[58] Field of Search ..... 156/555, 582, 583.1; 100/93 RP; 29/123, 130, 132, 129, 129.5; 219/216, 388, 469, 470, 471; 432/60, 288

[56] References Cited

U.S. PATENT DOCUMENTS

| | | | |
|---|---|---|---|
| 3,749,626 | 7/1973 | Buck | 156/510 |
| 4,001,544 | 1/1977 | Heinzer et al. | 100/93 RP |
| 4,229,950 | 10/1980 | Fessenden | 29/123 |

*Primary Examiner*—Michael G. Wityshyn

*Attorney, Agent, or Firm*—Linda Bierman; Jordan B. Bierman; C. Cornell Remsen, Jr.

[57] ABSTRACT

The fixing means for an electrostatic recording apparatus comprises a pair of revolving rollers in pressure contact with one another, of which at least one roller may be a heating roller, and in which each roller is a deformable thin cylinder supported for rotation at its ends by a resilient deformable end piece. The two revolving rollers are urged against one another by a pair of aligned pressure rollers extending along substantially the entire length of the revolving rollers and between them exerting a pressure against said revolving rollers in a direction perpendicular to the axes thereof. The result is to provide between the two revolving rollers a constant elastically deformable and restorable nip across the entire length of said revolving rollers. Because of this construction and the close contact between the rollers, their surface temperature can be quickly raised, a uniform nipping width is maintained, and no permanent roller deformation results.

3 Claims, 3 Drawing Figures

HEAT ROLLER TYPE FIXING MEANS

BACKGROUND OF THE INVENTION

1. Field of the Invention

The present invention relates to a heat roller fixing means with the object of shortening the warming up time by supporting a thin heat roller and a pressure roller with an elastic deforming member at the receiving nip.

2. Description of the Prior Art

In an electrostatic recording apparatus such as an electrophotographic copier and a facsimile apparatus, there have been known various systems for heat-fixing a toner image formed on a recording member. To roughly classify fixing systems being popularly utilized at present, there are two systems, a non-contact fixing system in which toner is fixed by heat with radiant energy such as infrared rays, and a contact fixing system in which a heating member is brought into contact with a recording member which holds the unfixed toner thereon and said toner is heated and fixed by the conduction heat radiated from the said heating member. As the fixing means of the latter system, there have generally been known and popularly put into practice a heat roller fixing means comprising a rotating heat roller with a built-in heater and a pressure contact roller which is brought into revolving pressure contact with said heat roller. The contact type fixing system is excellent in thermal efficiency, so that it has the advantages that it operates with a small consumption of electricity and can fix at a high speed; combined with the recent requirements for speeding up of the recording apparatus, there has been an increasing tendency to adopt such a system. On the other hand, this system has the defect that it takes a long time (i.e. a long warming up time) to raise the surface temperature of a heat roller up to the suitable temperature for fixation (150° C.–180° C.) after an electric current is applied to the heater in a heat roller.

Heretofore, in an attempt to shorten the warming up time, it has been possible to decrease this time by approximately one minute by increasing the power to the heating member and making a thin heat roller and decreasing the heat capacity. However, this has produced some problems such as that the consumed power for fixation is restricted in itself (e.g., 1.5 kw or lower) and that the heat roller under load is deformed by the external force mechanically generated by a pressure roller being brought into pressure contact with the thin heat roller. To cope with this problem, for example, there has been devised the method in which sponge rubber having a lower solidity is used as a pressure roller, the nipping width between a heat roller and the pressure roller is widened even if the pressure contact force is weak, and the thickness of the roller is thinned. In this case, however, if such a heat roller remains in contact with a pressure roller and at the fixing temperature for a long period of time, a problem of permanent deformation of such sponge roller may result. In the case that the thickness of a conventional heat roller is made extremely thin, there results a great difference of solidity between the flange portions at the both ends of the roller and the central portion thereof, so that this produces a problem in that the nipping width does not remain even in the longitudinal direction of the roller.

SUMMARY OF THE INVENTION

In consideration of the above-mentioned problems and in order to shorten a warming up time, a heat roller and a pressure contact roller each comprise an elastically deformable thin cylinder provided with a support member supporting the cylinder elastically deformably at the both ends of the cylinder.

DETAILED DESCRIPTION OF THE PREFERRED EMBODIMENTS

The following is the description of the present invention with reference to the attached drawings.

Figure 1:
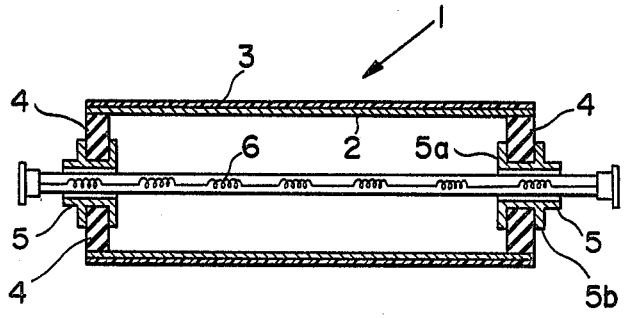
FIG. 1 shows a cross-sectional view of a roller showing the structure of a heat roller of a heat roller fixing means according to the present invention.
Figure 2:
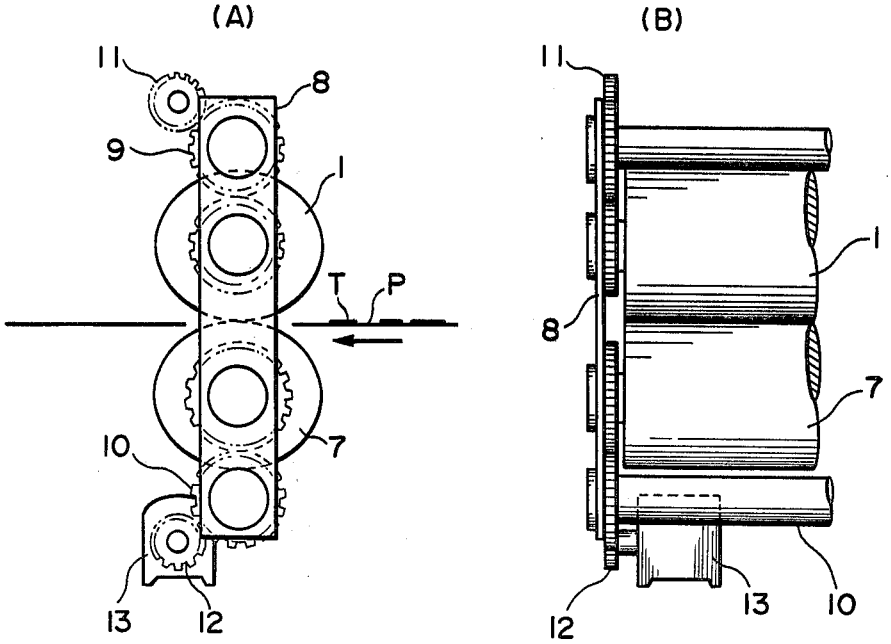
FIG. 2(A) is an end view of an essential part of the driving mechanism of a fixing means for the present invention.
FIG. 2(B) is a partial side view thereof.

As one of the preferable examples of the invention, the heat roller and the pressure roller can be the same in the structure, and the description will therefore be made with reference to the heat roller. The structure of heat roller 1 is shown in FIG. 1, in which a Teflon coating 3 (trademark, polytetrafluoroethylene) is formed on the outer circumferential surface of a thin metal roller 2 (e.g., 0.5 mm in thickness) in order to improve the toner releasing property. At both ends of the metal roller 2, driving members 5 are attached through elastic end pieces 4 formed of material such as silicon rubber. The thickness of the thin metal roller 2 is preferable 0.1–1.5 mm. Said driving members 5 are provided with flanges 5*a* and 5*b* so as to embrace said elastic members 4 between them. Gear teeth are provided on the outer circumference of outside flange 5*b* and the driving member 5 is rotated by such a driving mechanism as shown in FIGS. 2(A) and 2(B). Inside the metal roller 2, heater 6 is inserted axially through the sleeve of said driving members 5. As thus constituted the heat roller 1 can be elastically deformed when a force is applied over, the whole span of the roller in direction perpendicular to the axis.

FIGS. 2(A) and 2(B) illustrate an example of a fixing means comprising the above-mentioned constituting the heat roller and the corresponding pressure roller, wherein heat roller 1 and pressure roller 7 are pressed together by pressure adding rollers 9 and 10 acting perpendicular to their axis so as to bring them into pressure contact with each other. They are mounted within a supporting frame 8 in an elastically deformed state. In this example, heat roller 1 is driven by a driving gear 11 through the pressure adding roller 9, and the pressure roller 7 is driven by a driving gear 12 through the pressure roller 10. Driving gear 12 is driven for example by motor 13. The reason why heat roller 1 and pressure roller 7 are separately driven as described above is to prevent the rotation of the roller from being delayed because of the use of elastic member 5 at the both ends of the roller. Reference P designates a recording paper on which unfixed toner T is held and P is conveyed in the direction of the arrow.

In the above-mentioned fixing means, heat roller 1 and pressure roller 7 are always applied with pressure from a perpendicular direction to the axis and are thus deformed to come into pressure contact with each other with a wide nipping width, and in the case that heat roller 1 and pressure roller 7 are both incorporated with built-in heaters respectively, the temperature capable of fixing can be reached within a short period of time because they are made of thin metal rollers 2. According to the experiments in which halogen lamp heaters of 400 W were used on the upper and lower sides of the above-mentioned structure, the warming up time of the fixing means was about 12 seconds to reach the temperature at 180° C. The deforming state of both heat roller 1 and pressure roller 7 is not fixed as it is but is restorable at any time because of the elastic properties of metal roller 2 and elastic member 4, therefore even in the above-mentioned case, there was no permanent deformation observed on the metal roller or elastic deformation even if the heat roller was kept in pressure contact with pressure roller for a long period of time, and was also kept at the fixing temperature.

As described above, in the present invention, a heat roller and a pressure roller comprise an elastically deformable thin cylinder and support members elastically deformably supporting both ends of the cylinder and both rollers are applied with pressure from a perpendicular direction to the axis to be brought into pressure contact with each other over the whole span of the rollers. Thereby one obtains the effects that (1) the surface temperatures of the rollers can be raised up to the fixable temperature within a short period of time, (2) that a uniform nipping width can be formed on the roller cylinders, and (3) that a permanently non-deformable heat roller fixing means can be provided.

What is claimed is:

1. In a fixing means for an electrostatic recording apparatus and the like which comprise a pair of revolving rollers in pressure contact with one another to define a nip between them, and in which at least one of said rollers is a heating roller, the improvement comprising forming each of said rollers as a deformable thin cylinder, in combination with means elastically supporting each cylinder at its ends, and a pair of aligned pressure rollers extending substantially the full length of said revolving rollers and between them respectively exerting a pressure against said revolving rollers in a direction perpendicular to the axes thereof, whereby said pressure rollers acting upon said elastically supported deformable pressure rollers form between the latter a constant elastically deformable restorable nip across the entire length of said revolving rollers.

2. In a fixing means, the imrovement according to claim 1, in combination with means rotatably supporting each of said cylinders through their respective elastic supporting means, and in which said rotable supporting means includes means for individually driving each of said cylinders.

3. In a fixing means, the improvement according to claim 2, in which each of said rotatable supporting means comprises a pair of spaced flanges gripping said elastic supporting means between them.

* * * * *